US006027165A

United States Patent [19]

Adkins

[11] Patent Number: 6,027,165

[45] Date of Patent: Feb. 22, 2000

[54] TABLE ATTACHMENT FOR ARM CHAIRS

[76] Inventor: Avis V. Adkins, P.O. Box 221, Hollister, Fla. 32147

[21] Appl. No.: 09/332,862

[22] Filed: Jun. 15, 1999

[51] Int. Cl.[7] ..... A47C 7/68

[52] U.S. Cl. ..... 297/188.18; 297/173; 297/188.21; 108/73; 108/94

[58] Field of Search ..... 297/135, 173, 297/188.18, 188.21; 108/73, 94

[56] References Cited

U.S. PATENT DOCUMENTS

| | | | |
|---|---|---|---|
| 171,528 | 12/1875 | Musser . | |
| 936,017 | 10/1909 | McClelland . | |
| 2,617,473 | 11/1952 | Krimstock et al. | 297/188.18 X |
| 2,994,366 | 8/1961 | Hoch . | |
| 3,680,911 | 8/1972 | Dupuis . | |
| 3,751,108 | 8/1973 | Bakanowsky . | |
| 5,839,713 | 11/1998 | Wright | 297/188.18 X |
| 5,848,773 | 12/1998 | Bourassa | 297/135 X |

FOREIGN PATENT DOCUMENTS

| | | |
|---|---|---|
| 80967 | 3/1956 | Netherlands . |

*Primary Examiner*—Peter R. Brown
*Attorney, Agent, or Firm*—Stephen R. Greiner

[57] ABSTRACT

A table attachment for arm chairs including a base portion adapted to be clamped to a chair arm. The attachment includes a base portion and a table portion pivotally secured to the front end of the base portion. The table portion may be selectively positioned so that it projects outwardly from either side of the base portion to accommodate right or left-handed mounting conditions.

4 Claims, 2 Drawing Sheets

TABLE ATTACHMENT FOR ARM CHAIRS

FIELD OF THE INVENTION

The present invention relates generally to chairs and seats and, in particular, to a tablet-arm type table for attachment thereto.

BACKGROUND OF THE INVENTION

Surfing the Internet on personal computers has become a popular pastime for many. Unfortunately, personal computers can be uncomfortable to operate, sometimes requiring an individual to assume awkward positions to simultaneously view a monitor and manipulate a mouse or joy stick. Severe neck, shoulder, and arm strain can result from periods of prolonged computer use.

To obtain greater comfort when using a personal computer, some individuals will resort to balancing books, papers, and perhaps a computer peripheral such as a mouse, upon one arm of the chair in which they are sitting. Although this action may increase comfort, the balanced materials sometimes fall from their narrow perch requiring retrieval from the floor. A need, therefore, exists for a device which can be attached to the arm of a chair that will conveniently support work while a personal computer is being accessed.

SUMMARY OF THE INVENTION

In light of the problems associated with balancing things on the arms of chairs while working with computers, it is a principal object of the invention to provide an attachment for arm chairs which will support a variety of materials with great stability.

It is another object of the invention to provide a table attachment of the type described which may be fastened to arm chairs of varied size and shape without resort to tools. Thus, the table attachment can be easily used by individuals having a minimal mechanical aptitude.

It is an object of the invention to provide improved elements and arrangements thereof in a table attachment for the purposes described which is lightweight in construction, inexpensive to manufacture, and dependable in use.

Briefly, the attachment in accordance with this invention achieves the intended objects by featuring a base portion with a top panel and a bottom panel projecting forwardly of the front end thereof. Carriage bolts are suspended from the top panel and carry retaining blocks for clamping against the underside of a chair arm. A table portion is pivotally secured to the base portion. The table portion includes a plate from which a pivot pin extends downwardly through the bottom panel in a manner which permits the plate to be selectively elevated and pivoted. A compressed spring on the bottom of the pin selectively retains the plate against the bottom panel.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
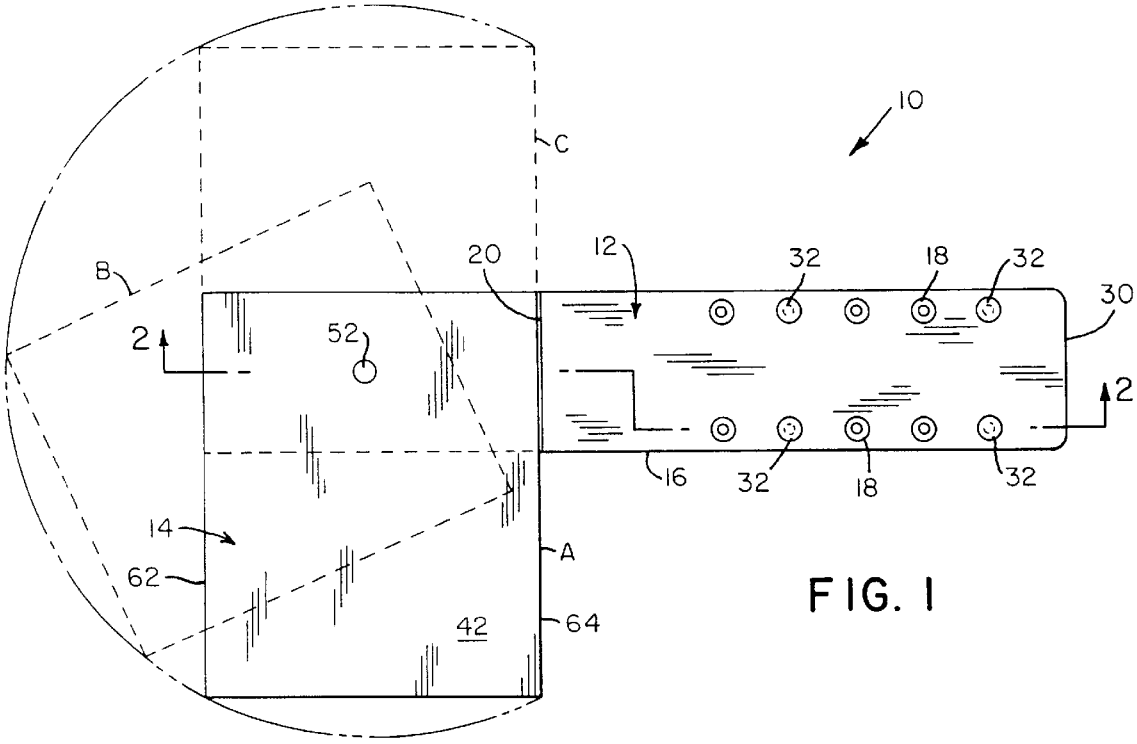
FIG. 1 is a top view of a table attachment for arm chairs in accordance with the present invention with two alternative positionings of the table portion being shown in broken lines.

Referring now to the FIGS., a table attachment in accordance with the present invention is shown at 10. The attachment 10 includes a base portion 12 and a table portion 14 pivotally secured to the front end of the base portion. The table portion 14 may be selectively positioned so that it projects outwardly from either side of the base portion 12 to accommodate right or left-handed mounting conditions.

The base portion 12 includes a top panel 16 having a row of countersunk apertures 18 extending along each of its opposite sides. Projecting forwardly of the front end 20 of the top panel 16 is a bottom panel 22 which is affixed to the underside of the top panel 16. The bottom panel 22 has an opening 24 located between its front end 26 and the front end 20 of top panel 16.

Two pairs of carriage bolts 28 are suspended from top panel 16 with one pair being located near the front end 20 of the top panel and the other pair being positioned near the rear end 30 thereof. The heads 32 of the bolts 28 are retained in the countersunk parts of apertures 18. The threaded shafts 34 of the bolts 28, however, extend downwardly through apertures 18 and from the underside of top panel 16.

Each pair of carriage bolts 28 carries a retaining block 36. As shown, each block 36 is provided with a pair of apertures 38 sized and spaced to receive the threaded shafts 34 of a pair of bolts 28 without binding. Each block 36 is retained on its associated pair of bolts 28 by a pair of wing nuts 40 threaded onto the shafts 34.

The table portion 14 includes a rectangular plate 42 having a threaded, pivot pin 46 extending downwardly therefrom. The head 48 of the pivot pin 46 is positioned within the countersunk portion of an aperture 50 located adjacent one end of the plate 42 and retained in place by a snug-fitting cap 52. The threaded shaft 54 of the pin 46 extends outwardly from the aperture 50 and downwardly from the underside of the plate 42. The threaded shaft 54 extends through the opening 24 in bottom panel 22. A wing nut 56 threaded onto the shaft 54 secures table portion 14 to base portion 12.

A compressed spring 56 positioned between the wing nut 56 and the underside of the bottom panel 22 urges the plate 42 against the top of the bottom panel. So as to prevent binding against the wing nut 56 and bottom panel 22, load-distributing washers 60 are preferably positioned on shaft 54 at opposite ends of spring 58.

Figure 2:
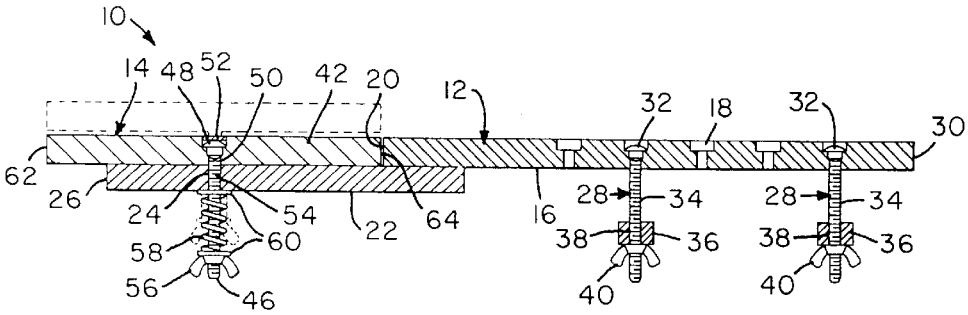
FIG. 2 is a cross-sectional view taken along line 2—2 of FIG. 1 with broken lines indicating the elevated position of the table portion which permits the pivoting thereof.
Figure 3:
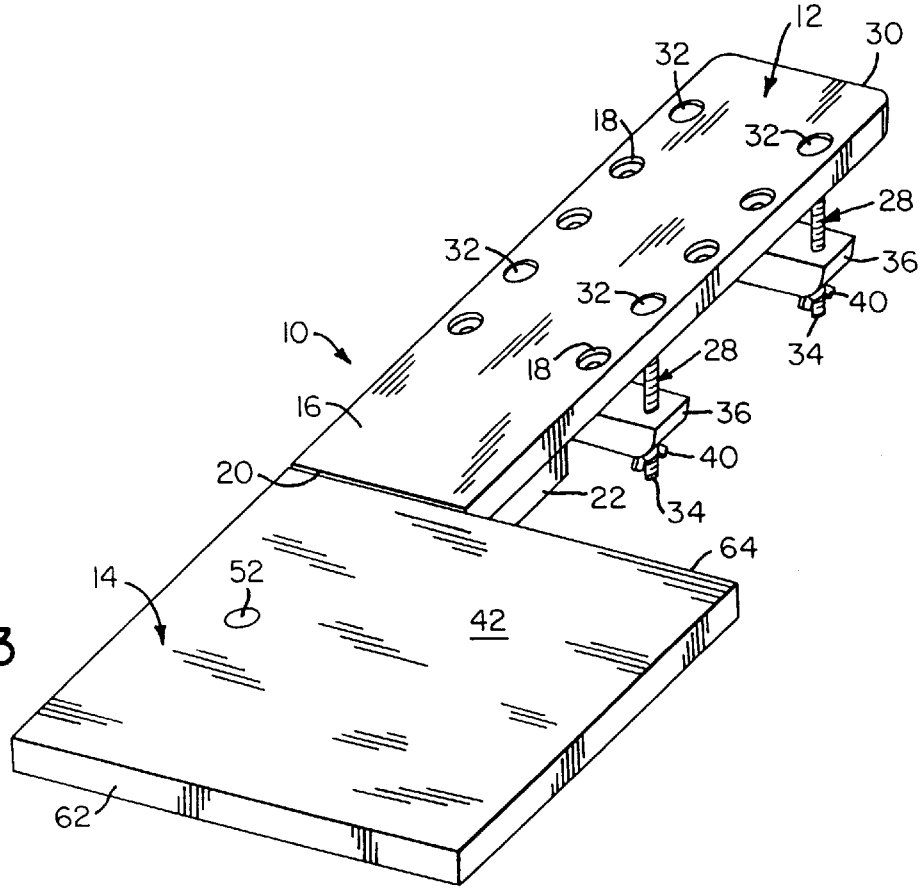
FIG. 3 is a perspective view of the table attachment for arm chairs.

Use of table attachment 10 is straightforward. First, with blocks 36 removed, top panel 32 is positioned atop the right or left arm of a chair (not shown) with the threaded shafts 34 straddling the chair arm. Next, blocks 36 are positioned on shafts 34 and pressed against the underside of the chair arm by tightening wing nuts 40. Finally, table portion 14 is oriented into the desired, left-oriented position "A" in FIG. 1 or right-oriented position "C" by lifting upwardly on plate 42 against the force of spring 58 as shown in FIG. 2, rotating plate 42 through position "B" to the desired position, and releasing plate 42. Spring 58 holds plate 42 snugly against bottom panel 22 once released.

By positioning pin 46 midway between the sides 62 and 64 of plate 42 and by positioning the center of opening 24 at a distance equal to about one-half of the width of plate 42 from the front end 20 of top panel 16, as shown, the front end 20 of top panel 16 serves as an abutment surface for a selected one of the sides 62 and 64 of plate 42. Thus, the construction of the base portion 12 and table portion 14 prevents the unintentional rotation of the plate 42 during use of table attachment 10.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A table attachment, comprising:

a base portion for fastening to a chair arm, said base portion including:

a top panel having a front end, a rear end and a pair of first opposed sides, said top panel also having two rows of first apertures each respectively positioned adjacent one of said first opposed sides;

a bottom panel projecting forwardly of said front end of said top panel and being affixed to the bottom of said top panel, said bottom panel also having an opening spaced from said top panel;

a pair of carriage bolts suspended from said top panel, said bolts having first threaded shafts extending from both a selected pair of said first apertures and the bottom of said top panel;

a retaining block carried by said carriage bolts, said retaining block having a pair of spaced-apart apertures through which said first threaded shafts are extended;

a pair of first nuts for holding said retaining block on said first threaded shafts, each of said first nuts being respectively positioned on one of said first threaded shafts; and, a table portion pivotally secured to said base portion, said table portion including:

a plate positioned atop said bottom panel of said base portion, said plate having a pair of second opposed sides having a spacing substantially equal to twice the distance between said opening in said bottom panel from said front end of said top panel, said plate also having a second aperture positioned midway between said second opposed sides;

a pivot pin suspended from said plate, said pivot pin having a second threaded shaft extending from said second aperture and through said opening in said bottom panel;

a compressed spring on said second threaded shaft of said pivot pin;

a second nut on said second threaded shaft for holding said compressed spring on said second threaded shaft.

2. The table attachment according to claim 1 wherein said first apertures and said second aperture are all countersunk.

3. The table attachment according to claim 2 wherein said first nuts and said second nut are all wing nuts.

4. A table attachment, comprising:

a base portion for fastening to a chair arm, said base portion including:

a top panel having a front end;

a bottom panel projecting forwardly of said front end of said top panel and being affixed to the bottom of said top panel, said bottom panel also having an opening spaced from said top panel;

means associated with said top panel for fastening said top panel to a chair arm; and, a table portion pivotally secured to said base portion, said table portion including:

a plate positioned atop said bottom panel of said base portion, said plate having a pair of opposed sides having a spacing substantially equal to twice the distance between said opening in said bottom panel from said front end of said top panel, said plate also having an aperture positioned midway between said opposed sides;

a pivot pin suspended from said plate, said pivot pin having a threaded shaft extending from said aperture and through said opening in said bottom panel;

means associated with said pivot pin for selectively urging said plate toward said bottom panel;

a nut on said threaded shaft for holding said urging means on said threaded shaft.

* * * * *